United States Patent [19]

Broderick

[11] Patent Number: 4,622,732

[45] Date of Patent: Nov. 18, 1986

[54] METHOD FOR FORMING JOINTS IN PRESSURIZED FLUID SYSTEMS

[75] Inventor: Frederick J. Broderick, Woodland Hills, Calif.

[73] Assignee: Haskel, Inc., Burbank, Calif.

[21] Appl. No.: 674,516

[22] Filed: Nov. 23, 1984

[51] Int. Cl.[4] ..... B23P 17/00; B21D 39/00; F16L 17/00

[52] U.S. Cl. ..... 29/421 R; 29/523; 285/354

[58] Field of Search ..... 29/421 R, 523; 285/354, 285/387.4, 387.5

[56] References Cited

U.S. PATENT DOCUMENTS

| | | | |
|---|---|---|---|
| 4,152,821 | 5/1979 | Scott | 29/507 |
| 4,165,106 | 8/1979 | Gladden | 285/354 |
| 4,368,571 | 1/1983 | Cooper | 29/523 |
| 4,388,752 | 6/1983 | Vinciguerra | 29/446 |
| 4,420,867 | 12/1983 | Busse | 29/523 |
| 4,421,237 | 12/1983 | Nusbaumer et al. | 29/523 |
| 4,456,287 | 6/1984 | Bisonaya | 285/354 |
| 4,458,926 | 7/1984 | Williamson | 285/354 |

FOREIGN PATENT DOCUMENTS

| | | | |
|---|---|---|---|
| 1012713 | 12/1965 | United Kingdom | 285/350 |

*Primary Examiner*—Howard N. Goldberg
*Assistant Examiner*—Steven Nichols
*Attorney, Agent, or Firm*—Pretty, Schroeder Brueggemann & Clark

[57] ABSTRACT

A joint assembly for use with pressurized fluid systems employs a tube that is secured to a ferrule, preferably by hydraulic swaging. During the swaging operation, a projecting end of the tube can be expanded against a die and thereby pre-sized. A sealing ring is then placed on the projecting end of the tube and enclosed within a cavity formed when a fitting is secured to the ferrule by a retainer. A spring that energizes the seal can be included in the cavity. The seal is formed between concentric circumferential surfaces and is independent of axial movement of the joint elements. A metal-to-metal backup seal can be formed by the ferrule and the fitting.

10 Claims, 3 Drawing Figures

METHOD FOR FORMING JOINTS IN PRESSURIZED FLUID SYSTEMS

FIELD OF THE INVENTION

The present invention relates to methods for forming seals and, more particularly, to methods for sealing joints in pressurized fluid systems.

BACKGROUND OF THE INVENTION

Pressurized fluid systems generally employ metal tubes connected at the ends to fittings. A joint, that should be free of leaks, must be formed at each fitting. Conventionally, this is accomplished by first permanently attaching a ferrule to the tube, usually by hydraulic swaging or by roller swaging. Hydraulic swaging is preferred and is described in U.S. Pats. Nos. 4,407,150; 4,414,739; 4,450,612 and 4,359,889. The ferrule is configured to mate with the fitting. Usually, a retainer nut is used to pull the ferrule and the fitting together axially.

The axial retaining forces, which must overcome the force of the pressurized fluid, are conventionally relied upon to provide the sealing forces by tightly pressing together two abutting surfaces. Seals thus formed are known as "face seals". They may be metal-to-metal seals or they may includes O-rings. However, face seals are prone to leakage because of their dependency on eliminating virtually all axial movement between the ferrule and the fitting.

An objective of the present invention is to provide a method for forming an improved seal for use in pressurized fluid systems that is not dependent upon the elimination of axial movement. A further objective is to provide a method for forming such a seal in which the force of the pressurized fluid tends to close rather than open the seal. A still further objective is to provide a method for forming such a seal that is relatively simple, easily assembled and easily checked for integrity.

SUMMARY OF THE INVENTION

The method of the present invention accomplishes the above objectives. First a tube is inserted in an annular ferrule and positioned so that one end of the tube projects slightly beyond the ferrule. The ferrule and the projecting end of the tube are confined within a die and hydraulic swaging pressure is applied within the tube, preferably by inserting a swaging mandrel. The pressure causes the tube to expand radially against the inside of the ferrule and causes a bulge to form on the tube and pentetrate an internal groove in the ferrule, interlocking the tube and the ferrule. At the same time, the projecting end of the tube expands against a surface of the die, thus pre-sizing the end. The tube is thus given an outside diameter that falls within a small tolerance range.

After removing the die and withdrawing the mandrel, a deformable sealing ring is place on the projecting end of the tube. The ferrule is then secured to the fitting, preferably by rotating a retaining nut. An annular cavity surrounding the tube is thus defined in which the sealing ring is disposed. A seal is formed on the inside and the outside of the sealing ring. A backup seal, which may be a metal-to-metal seal, can be formed between the ferrule and the fitting.

It is preferable to place a resilient member, such as a belleville spring, in the cavity along with the sealing ring to energize the ring.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figure 1:
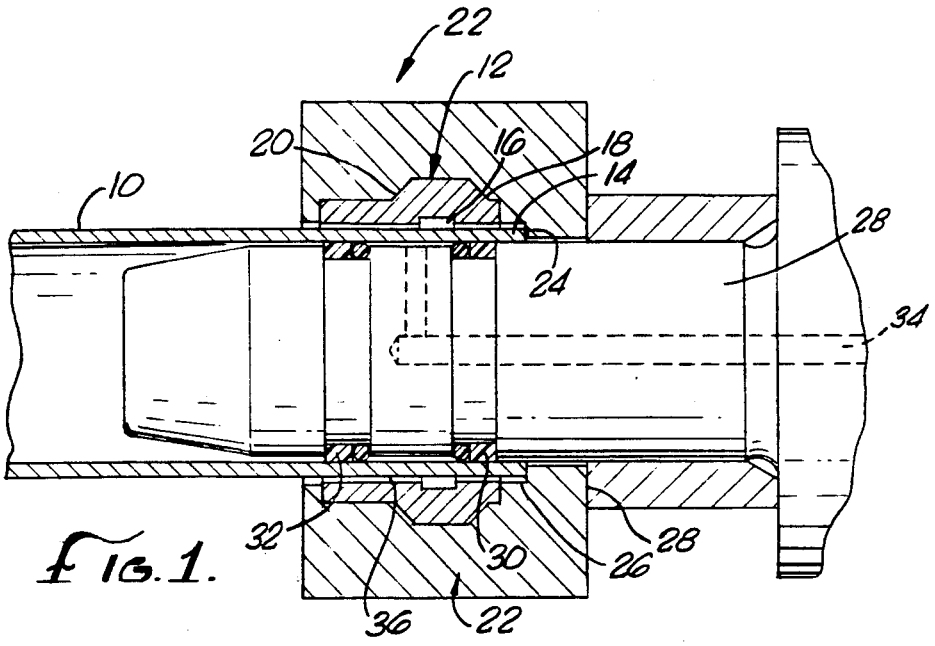
FIG. 1 is a longitudinal cross sectional view of a tube and a ferrule within a die, a mandrel having been inserted in the tube, and the tube being positioned to be swaged as the first step in forming a joint in accordance with the present invention.

A metal tube 10 suitable for carrying pressurized fluid, shown in FIG. 1, is inserted in an annular metal ferrule 12 as the first step in forming a joint in accordance with the present invention. The tube 10 is positioned so that a short end portion 14 projects beyond the ferrule 12.

To permit attachment to the tube 10, the ferrule 12 includes an internal annular groove 16 positioned within the thickest portion of the ferrule between a leading external conical shoulder 18 and a trailing external conical shoulder 20. A die 22 of split jaw construction is clamped over the tube 10 and the ferrule 12. The interior of the die 22 conforms to the external configuration of the ferrule 12, thus preventing deformation of the ferrule under swaging pressure. In addition, the die 22 is shaped to enclose the projecting end portion 14 of the tube 10 and includes a stop that insures accurate axial positioning of the tube within the ferrule 12.

A critical feature of the dei 22 is a cylindrical surface 26 that surrounds the projecting end 14 of the tube 10. The diameter of this cylindrical surface 26 slightly exceeds the outside diameter of the tube 10 and is preferably equal to the inside diameter of the ferrule 12.

A swaging mandrel 28 is inserted in the tube 10 until it comes to rest against the die 22. This contact between the mandrel 28 and the die 22 insures correct axial positioning of the mandrel within the tube 10 so that two mandrel seals 30 and 32 define the axial limits of a pressure zone that is approximately coextensive axially with the ferrule 12. Pressurized hydraulic swaging fluid is then supplied through a passageway 34 in the mandrel 28 to a thin annular space 36 between the mandrel and the tube 10 that extends axially between the mandrel seals 30 and 32. The pressure of this swaging fluid must be selected in view of the characteristics of the tube 10 and the requirements of the joint to be formed. Pressure ranging from 30,000 to 100,000 psi is typically suitable.

Figure 2:
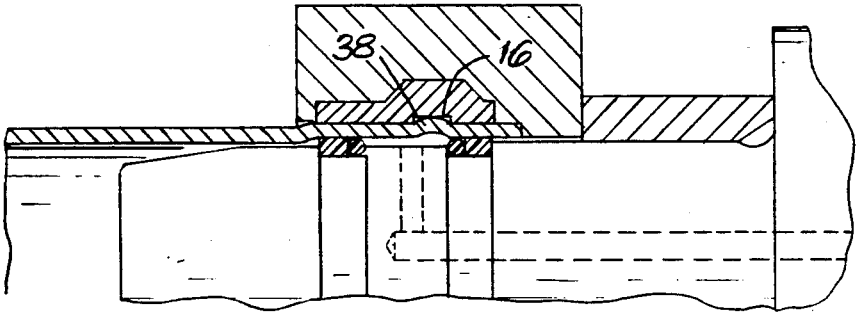
FIG. 2 is a cross sectional view similar to FIG. 1, but showing the configuration of the tube after the swaging process has been completed.

The application of swaging pressure deforms the tube 10 radially outwardly, as shown in FIG. 2. An annular bulge 38 is thus formed on the tube 10 extending into the groove 16 in the ferrule 12, thus firmly anchoring the ferrule to the tube and preventing axial movement of the ferrule. It is important to note that the projecting end 14 of the tube 10 expands radially with the portion of the tube to which it is attached even though the pressure zone ends short of the projecting end at the trailing mandrel seal 30. Of course, the pressure zone can be extended toward the end of the tube 10 if desired.

It is an important aspect of the swaging process that it pre-sizes the tube 10 by forcing the tube radially outwardly against the encircling cylindrical surface 26 of the die 22. It has been found that tubes of the type used in pressurized fluid systems have a relatively wide tolerance associated with the outside diameter. However, the die 22 can be made with considerable accuracy and the projecting end 14 of the tube 10 is thus given as an outside diameter of a predetermined size that varies only within a comparatively small tolerance range.

Figure 3:
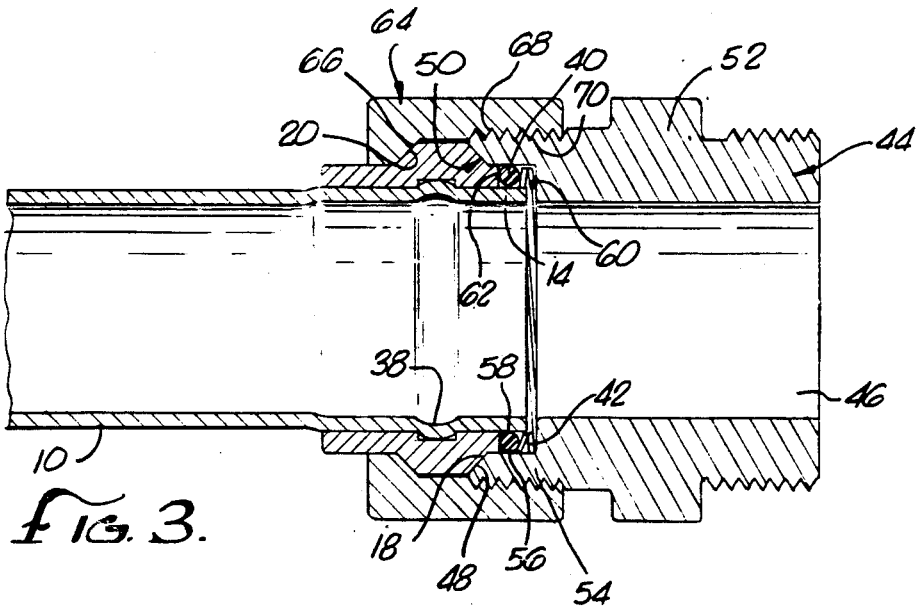
FIG. 3 is another longitudinal cross sectional view showing a joint assembly that has been completed in accordance with the present invention.

Once the swaging operation is completed, the die 22 is opened and removed from the tube 10 and the ferrule 12 and the mandrel 28 is withdrawn from the tube. A Teflon sealing ring 40 is then placed over the projecting end 14 of the tube 10, as shown in FIG. 3. Teflon is chosen because it is chemically inert and it lasts indefinitely without cracking or chipping. The cold flow characteristics of Teflon are desirable and the elastic memory associated with a conventional O-ring is not needed.

Next a pair of belleville springs 42 are placed on the projecting end 14 of the tube adjacent to the ring 40. Then the ferrule 12 is mated with an annular fitting 44. As shown in FIG. 3, the fitting 44 defines an axial bore 46 that is aligned with the tube 10. The diameter of the bore 46 matches the inside diameter of the tube 10. A leading edge 48 of the fitting 44 is conical and mates with the leading shoulder 18 of the ferrule 12 to form a metal-to-metal backup seal 50 on the low pressure side of the primary seal formed by the ring 40.

The fitting 44 includes an annular main body 52 and a thinner annular projection 54 with a larger inside diameter, the leading edge 48 being formed on the projection. An annular gland cavity is thus defined, the inner surface 56 of the projection 54 forming the outer circumferential surface of the cavity and the pre-size outer surface 58 of the tube 10 forming the inner circumferential surface of the cavity. This cavity contains the sealing ring 40 and the belleville springs 42. The axial limits of the cavity are defined by an annular shoulder 60 on the leading end of the main body 52 of the fitting 44 and by an annular end surface 62 of the ferrule 12. Both the shoulder 60 and the end surface 62 are radially oriented with respect to the tube 10.

A retainer nut 62 is provided to secure the ferrule 12 to the fitting 44 and is intended to prevent or minimize relative axial movement between these two components. The retainer 64 has a conical inner surface 66 that mates with the trailing shoulder 20 of the ferrule 12 to urge the ferrule axially toward the fitting 44. An internal threaded surface 68 of the retainer 64 engages an external threaded surface 70 of the fitting 44. By rotating the retainer 64, the ferrule 12 and the fitting 44 are drawn together axially until the shoulder 18 and the edge 48 are pressed tightly against each other to form the metal-to-metal backup seal 50.

The sealing ring 40 fits tightly between the opposing circumferential surfaces 56 and 58 of the fitting 44 and the tube 10, these surfaces having close tolerances. However, to be sure that the ring 40 is expanded radially against these circumferential surfaces 56 and 58, the belleville springs 42 compress the ring axially against the end surface 62 of the ferrule 12, thus energizing the seal prior to the application of normal operating fluid pressure within the tube 10. When this fluid pressure is applied later, the fluid passes freely through a space between the projecting end of the tube 10 and the shoulder 60 of the fitting 44 to enter the gland cavity in which the ring 40 is disposed. The ring 40 is thus pressed more firmly against the ferrule 12. Accordingly, the ring 40 forms a tight leak-proof primary seal that is not dependent on the axial positions of the joint elements. Since the ferrule 12 and the fitting 44 are made to close tolerances and the tube 10 is swaged to the ferrule, there are no voids into which the ring 40 can deform plastically. The hydraulically swaged connection between the tube 10 and the ferrule 12 is also leak proof. The use of brazing and other techniques that could destroy the heat treatment of the tube are avoided entirely. Moreover, it is possible to verify the integrity of the joint by inspection of the penetration of the tube bulge 38 into the groove 16, whereas other techniques such as brazing make verification difficult or impossible. The invention is suitable for virtually any size or thickness of tube.

While a particular form of the invention has been illustrated and described, it will be apparent that various modifications can be made without departing from the spirit and scope of the invention.

I claim:

1. In a pressurized fluid system, a method for forming a joint between a metal tube and a fitting, said fitting being adapted to accept a tube of a predetermined outside diameter, said method comprising:

inserting an end of said tube in an annular ferrule having an internal annular groove, and positioning said tube such that an end portion thereof projects beyond said ferrule;

closing a die around said ferrule and said end portion a portion of said die having an inside diameter conforming to said predeterming outside diameter;

inserting a mandrel into said tube and supplying pressurized swaging fluid through said mandrel to an annular space between said mandrel and said tube, thus (1) expanding said tube radially to form an annular bulge on said tube that extends into said groove whereby said tube is interlocked with said ferrule, and (2) pre-sizing said end portion of said tube to said predetermined outside diameter by pressing it against a surface of said portion of said die;

opening and removing said die;

withdrawing said mandrel from said tube;

placing a deformable sealing ring over said end portion;

positioning said tube and said ferrule with respect to said fitting, so as to define an annular cavity bounded by said end portion, said ferrule and said fitting in which said sealing ring is disposed; and securing said ferrule to said fitting.

2. The method of claim 1 further comprising the step of placing a resilient member in said annular cavity and thereby energizing said ring.

3. The method of claim 2 wherein said fitting is secured to said ferrule by causing a retaining nut to engage a shoulder on said ferrule and by rotating said nut and thereby causing it to threadedly engage said fitting.

4. The method of claim 1 wherein said fitting is secured to said ferrule by rotating a retaining nut.

5. The method of claim 1 wherein said fitting is secured to said ferrule by causing a retaining nut to engage a shoulder on said ferrule and by rotating said nut and thereby causing it to threadedly engage said fitting.

6. In a pressurized fluid system, a method for forming a joint between a metal tube and a fitting, said fitting being adapted to accept a tube of a predetermined outside diameter, said method comprising:

inserting an end of said tube in an annular ferrule having an internal annular groove, and positioning said tube such that an end portion thereof projects beyond said ferrule;

closing a die around said ferrule and said end portion a portion of said die having an outside diameter conforming to said predetermined outside diamter;

inserting a mandrel into said tube and supplying pressurized swaging fluid through said mandrel to an annular space between said mandrel and said tube, thus expanding said tube radially, forming an annular bulge on said tube that extends into said groove whereby said tube is interlocked with said ferrule, and pre-sizing end portion of said tube to said predetermined outside diameter by pressing it against a surface of a said portion of said die;

opening and removing said die;

withdrawing said mandrel from said tube;

placing a deformable sealing ring over said end portion;

aligning said tube and said ferrule with said fitting and bringing said fitting into contact with said ferrule to form a metal-to-metal backup seal, thus defining an annular cavity bounded by said tube, said ferrule and said fitting in which said sealing ring is disposed; and securing said ferrule to said fitting.

7. The method of claim 6 further comprising the step of placing a resilient member in said annular cavity and thereby energizing said ring.

8. The method of claim 6 wherein said fitting is secured to said ferrule by rotating as retaining nut.

9. The method of claim 6 wherein said fitting is secured to said ferrule by causing a retaining nut to engage a shoulder on said ferrule and by rotating said nut and thereby causing it to threadedly engage said fitting.

10. In a pressurized fluid system, a method for forming a joint between a metal tube and a fitting, said fitting being adapted to accept a tube of a predetermined outside diameter, said method comprising:

inserting an end of said tube in an annular ferrule having an internal annular groove, and positioning said tube such that an end portion thereof projects beyond said ferrule;

closing a die around said ferrule and said end portion a portion of said die having an inside diameter conforming to said predetermined outside diameter;

inserting a mandrel into said tube and applying pressurized swaging fluid through said mandrel to an annular space between said mandrel and said tube, thus expanding said tube radially, forming an annular bulge on said tube that extends into said groove whereby said tube is interlocked with said ferrule, and simultaneously pre-sizing said end portion of said tube to said predetermined outside diameter by pressing it against said portion of said die;

opening and removing said die;

withdrawing said mandrel from said tube;

placing a deformable sealing ring over said end portion in contact with concentric cicumferential surfaces of said cavity;

positioning a belleville spring adjacent to said ring;

aligning said tube with a bore in said fitting and bringing said fitting and said ferrule into engagement, thus compressing said spring to energize said ring and forming a metal-to-metal backup seal; and securing said ferrule to said fitting by causing a retaining nut to engage a shoulder on said ferrule and rotating said nut to threadedly engage said fitting.

* * * * *